US012618233B2

(12) United States Patent
Jiang et al.

(10) Patent No.: US 12,618,233 B2
(45) Date of Patent: May 5, 2026

(54) BOX-TYPE VARIABLE FREQUENCY WATER SUPPLY EQUIPMENT WITH ENERGY-SAVING FUNCTION

(71) Applicant: SHANGHAI YIMAI INDUSTRIAL CO., LTD., Shanghai (CN)

(72) Inventors: Jufeng Jiang, Shanghai (CN); Miao Cao, Shanghai (CN); Guoyong Gong, Shanghai (CN); Qinglin Wang, Shanghai (CN); Zhiming Chu, Shanghai (CN); Shiping Yuan, Shanghai (CN); Xuezhi Yu, Shanghai (CN); Wei Wang, Shanghai (CN)

(73) Assignee: SHANGHAI YIMAI INDUSTRIAL CO., LTD., Shanghai (CN)

( * ) Notice: Subject to any disclaimer, the term of this patent is extended or adjusted under 35 U.S.C. 154(b) by 320 days.

(21) Appl. No.: 18/684,826

(22) PCT Filed: Nov. 29, 2023

(86) PCT No.: PCT/CN2023/134993

§ 371 (c)(1),
(2) Date: Feb. 19, 2024

(87) PCT Pub. No.: WO2025/107338

PCT Pub. Date: May 30, 2025

(65) Prior Publication Data

US 2026/0110156 A1 Apr. 23, 2026

(30) Foreign Application Priority Data

Nov. 22, 2023 (CN) ..... 202311568551.3

(51) Int. Cl.
*E03B 7/07* (2006.01)
*E03B 11/00* (2006.01)

(52) U.S. Cl.
CPC ..... *E03B 7/075* (2013.01); *E03B 7/074* (2013.01); *E03B 11/00* (2013.01)

(58) Field of Classification Search
CPC ..... E03B 7/075; E03B 7/074; E03B 11/00
See application file for complete search history.

(56) References Cited

U.S. PATENT DOCUMENTS

2022/0186482 A1* 6/2022 Lin ..... E03D 9/08

FOREIGN PATENT DOCUMENTS

CN 113026871 A 6/2021
CN 113983001 U 1/2022
(Continued)

OTHER PUBLICATIONS

International Search Report in PCT/CN2023/134993, issued by ISA, dated Jul. 17, 2024.

(Continued)

*Primary Examiner* — P. Macade Nichols
(74) *Attorney, Agent, or Firm* — Zhu Lehnhoff LLP

(57) ABSTRACT

The present invention discloses box-type variable frequency water supply equipment with an energy-saving function, and relates to the technical field of water supply equipment, including: a water tank, wherein the side wall of the water tank is provided with a water inlet and a water outlet, one end of the water outlet away from the water tank is provided with a pump set device, and the water tank is provided therein with a cleaning device; the water in the water tank is delivered to a water pump in the pump set device via the water outlet, and the water pump extracts water into a pipe system so as to realize pipeline water supply; in the process of delivering water in the water tank to the water outlet, the controller controls the cleaning device to start, and the cleaning device thereupon rotates under the action of the water flow; in the process of rotating the cleaning device, the (Continued)

inner wall of the water tank is cleaned, and the cleaning device cleans impurities attached to the inner wall of the water tank to avoid impurities accumulating on the inner wall to form scales, so as to prolong the maintenance period of the water tank and save the maintenance cost of the water tank; and secondly, the water tank is cleaned via the cleaning device such that the water quality in the water tank is improved.

7 Claims, 6 Drawing Sheets

(56) References Cited

FOREIGN PATENT DOCUMENTS

| | | | | | |
|---|---|---|---|---|---|
| CN | 215563025 | U | 1/2022 | | |
| CN | 115341620 | U | 11/2022 | | |
| CN | 115874684 | A | 3/2023 | | |
| CN | 116025036 | A | 4/2023 | | |
| CN | 116065663 | A | 5/2023 | | |
| WO | WO-2008022766 | A1 * | 2/2008 | ..... | E03B 7/075 |

OTHER PUBLICATIONS

Written Opinion of the International Search Report in PCT/CN2023/134993, issued by ISA, dated Jul. 17, 2024.

* cited by examiner

BOX-TYPE VARIABLE FREQUENCY WATER SUPPLY EQUIPMENT WITH ENERGY-SAVING FUNCTION

TECHNICAL FIELD

The present invention relates to the technical field of water supply equipment, particularly to box-type variable frequency water supply equipment with an energy-saving function.

BACKGROUND

A water supply system refers to a complex of reservoirs, water pumps, pipelines, and other projects required by supplying water to different water consumption departments according to certain quality requirements. As for the technical functions of the water supply system, the whole water supply system should meet the user's requirements for water quality, water quantity, and water pressure. In addition, the entire infrastructure construction process and production operation also require low capital investment, often with low operating costs and convenient operation. Box-type water supply equipment can safely produce water and fully leverage the economic benefits of the entire water supply system.

The existing water supply device generally cleans a water tank during maintenance. After a long time of water supply, impurities in the water tank have accumulated into scales, which are difficult to clean. Scales accumulate on the inner wall, which easily erodes the inner wall, thereby causing damage to the water tank.

SUMMARY OF THE INVENTION

The object of the present invention is to provide box-type variable frequency water supply equipment with an energy-saving function to solve the problem set forth in the background art.

In order to solve the above technical problem, the present invention provides the following technical solutions.

Box-type variable frequency water supply equipment with an energy-saving function includes a water tank, wherein the side wall of the water tank is provided with a water inlet and a water outlet, one end of the water outlet away from the water tank is provided with a pump set device, a cleaning device is provided in the water tank, a water pump is provided in the pump set device, and the water pump is in communication with the water outlet via a pipeline. The cleaning device includes: a rotating shaft, wherein the rotating shaft is arranged in the water tank, and the rotating shaft is rotatably connected to the inner wall of the water tank.

A worker controls the water inlet to open via a controller, and then water is delivered to the water tank via the water inlet for storage; when the water consumption increases, the controller controls the pump set device to start and the water outlet to open; the water pump in the pump set device extracts water from the water tank; the water in the water tank is then delivered to the water pump in the pump set device via the water outlet; the water pump extracts water into the pipe system so as to realize pipeline water supply; and during the delivery of the water in the water tank to the water outlet, the controller controls the cleaning device to start, and the cleaning device then rotates under the action of the water flow. During the rotation of the cleaning device, the inner wall of the water tank is cleaned, and the cleaning device cleans impurities attached to the inner wall of the water tank to prevent impurities from accumulating on the inner wall to form scales. It extends the maintenance period of the water tank and saves the maintenance costs of the water tank. Secondly, the water tank is cleaned via the cleaning device such that the water quality in the water tank is improved.

Preferably, several retaining rings are arranged on the rotating shaft, several support arms are arranged on one side of the retaining rings away from the rotating shaft, the support arms are arranged around an axis of the retaining rings, several impeller blades are arranged between two adjacent support arms, and the impeller blades form an included angle with the support arms.

Preferably, an electromagnetic coil is provided inside the water tank with the support arm away from the retaining ring, the support arm is a magnetic conductor, a cleaning groove is provided on one side of the support arm near the water outlet, a cleaning rod is provided inside the cleaning groove, and the cleaning rod is rotatably connected to the cleaning groove via a rotating shaft.

Preferably, a power cavity is provided inside the cleaning groove, a rotating shaft in the cleaning rod passes through the power cavity and is provided with a rotating gear, the rotating gear is an incomplete gear, a sliding groove is provided on one side of the support arm away from the cleaning groove, a sliding block is slidably connected in the sliding groove, a pull rope is provided inside the sliding groove, one end of the pull rope is connected to the sliding block, the other end of the pull rope is connected to the rotating shaft on the cleaning rod, and a torsion spring is provided on the rotating shaft on the cleaning rod.

Preferably, two moving grooves are provided on the shaft arm of the rotating shaft, one of the moving grooves is provided on one side of the rotating shaft near the water inlet and the other moving groove is provided on one side of the rotating shaft near the water outlet, the retaining ring is slidably connected to the moving groove, and an electromagnetic spring is provided in the moving groove. One end of the electromagnetic spring is connected to the retaining ring, and the other end of the electromagnetic spring is connected to the side wall of the moving groove.

Preferably, several impeller blades on the retaining ring are arranged in an intersecting manner, the impeller blades are combined into one complete impeller, and a filter screen is provided in the water outlet;

after the controller controls the pump set device to start, the water in the water tank is then delivered into the pipeline under the action of the water pump, the water in the water tank moves from one side of the water inlet to the water outlet, and during the delivery of the water in the water tank, the water flow impacts the impeller blade, the impeller blade then generates a rotating force under the action of the water flow, and the impeller blade then rotates; and during the rotation of the impeller blade, the impeller blade drives the support arm to rotate, the rotation of the support arm drives the rotation of the retaining ring, and when the retaining ring rotates, the retaining ring drives the rotating shaft to rotate;

since the support arm is a magnetic conductor, during the rotation of the support arm, the support arm continuously cuts the magnetic induction line in the electromagnetic coil provided inside the water tank, so that the electromagnetic coil generates a magnetic force, thereby enabling magnetically generated electricity, and the electricity generated by the electromagnetic coil is then delivered to a storage battery for storage via a circuit, thereby achieving the utilization rate of resources, resulting in energy-saving effects;

during the rotation of the support arm, the sliding block then moves under the action of the centrifugal force; the sliding block moves along the sliding groove to one side away from the retaining ring; since the electromagnetic coil generates a magnetic force during the rotation of the support arm, the magnetic force also attracts the sliding block to move to one side near the inner wall of the water tank; during the movement of the sliding block, the sliding block drives the pull rope to move, and the pull rope is then pulled; during the sliding pulling of the pull rope, the other end of the pull rope pulls the rotating shaft on the cleaning rod to rotate; during the rotation of the rotating shaft, the rotating shaft drives the cleaning rod to rotate; the cleaning rod moves to one side away from the cleaning groove; after rotating, the cleaning rod contacts the inner wall of the water tank; when the impeller blade rotates, the support arm is driven to rotate; when the support arm rotates, the cleaning rod is driven to rotate; during the rotation of the cleaning rod, the inner wall of the water tank is cleaned, and impurities attached to the inner wall of the water tank are cleaned, so as to avoid impurities attached to the inner wall of the water tank to form scales; and impurities in the water tank are also not easy to attach to the inner wall of the water tank under the stirring action of the support arm and the impeller blade, thereby extending the maintenance period of the water tank, saving the maintenance cost of the water tank, and improving the water quality in the water tank;

the rotation drives the rotating gear in the power cavity to rotate; since the rotating gear is an incomplete gear, when the sliding block moves to the end of the sliding groove, the rotating gear is disengaged from the constraint of the teeth at this moment, and then the rotating gear is reset under the action of the torsion spring; and in the process of resetting, the rotating gear drives the rotating shaft to reset, the rotating shaft drives the cleaning rod to reset, and the cleaning rod rotates to one side of the cleaning groove, so as to realize multiple intermittent cleaning of the inner wall of the water tank, thereby improving the cleaning efficiency and thus enhancing the quality of cleaning;

when it is necessary to stop the water supply, when the controller is controlling the pump set device to turn off, the controller controls the electromagnetic spring in the moving groove to be energized, and the electromagnetic spring contracts upon being energized; in the process of the contraction, the electromagnetic spring drives the retaining ring to move, the retaining rings on two sides move along the moving groove to one side away from the water inlet and one side away from the water outlet respectively, and then the controller controls the pump set device to turn off; at this moment, the staggered impeller blades are combined into one impeller whole, water forms a water hammer after the valve is closed, the water hammer impacts on the impeller blades, and the staggered impeller blades disperse the impact force of the water hammer; and therefore, the influence of the water hammer on the pump set device is reduced, and the pump set device is protected;

the cleaned impurities are delivered to the water outlet under the action of the water flow; and during the delivery, the impurities encounter a filter screen provided in the water outlet, and the impurities are then filtered by a filter plate screen; and the water flow is used to drive the rotation of the support arm, and in the process of the rotation of the support arm, the cleaning rod is driven to clean the inner wall of the water tank, and at the same time, in the process of the rotation of the support arm, the support arm cuts the magnetic induction line, so that the electromagnetic coil enables magnetically generated electricity, thereby improving the utilization rate of resources and achieving the effect of energy saving.

Preferably, a storage battery is provided between the water tank and the pump set device, and an included angle between the impeller blade and the support arm is 30°-45°.

Preferably, a thermal power conversion device is provided in the pump set device, a vibration generator is further provided in the pump set device, the thermal power conversion device is electrically connected to a storage battery, the storage battery is electrically connected to the vibration generator, and a vibration frequency sensor is provided in the pump set device;

during the rotation of the cleaning device, the action of cutting a magnetic induction line is performed in the electromagnetic coil, so that the electromagnetic coil generates a magnetic force, enabling magnetically generated electricity, and the electricity is then delivered to the storage battery via a circuit for storage; the pump set device is started under the control of the controller, and the water pump in the pump set device generates heat during the operation; the heat accumulates in the pump set device, the thermal power conversion device is thereupon started under the control of the controller, and the thermal power conversion device thereupon converts the heat in the pump set device into an electric energy; and the electric energy is also delivered to a storage battery for storage via a circuit, and after the thermal power conversion device converts the heat in the pump set device, it improves the heat dissipation efficiency in the pump set device and increases the utilization rate of thermal energy such that not only the heat dissipation in the pump set device is realized, but also the thermal energy is used; and since the water pump may generate noise during its operation, the vibration frequency sensor converts the vibration frequency signal generated by the noise into an electrical signal and transmits the same to the controller; the controller thereupon analyzes the same, then the controller controls the vibration generator in the pump set device to start, and then the storage battery delivers the stored electric energy to the vibration generator via a circuit; and according to the vibration frequency received by the vibration frequency sensor, the controller controls the vibration generator to generate a relative vibration frequency, so that the vibration frequency of the noise and the vibration frequency generated by the vibration generator cancel each other out, thereby achieving the attenuation of the noise, and thus achieving the purpose of noise reduction and improving the noise reduction effect of the pump set device.

Compared with the prior art, the beneficial effects of the present invention are as follows.

1. The water flow is used to drive the rotation of the support arm, and in the process of the rotation of the support arm, the cleaning rod is driven to clean the inner wall of the water tank, and at the same time, in the process of the rotation of the support arm, the support arm cuts the magnetic induction line, so that the electromagnetic coil enables magnetically generated electricity, thereby improving the utilization rate of resources and achieving the effect of energy saving.

2. After the thermal power conversion device converts the heat in the pump set device, the heat dissipation efficiency in the pump set device is improved, and the utilization rate of the thermal energy is improved, which not only achieves the heat dissipation in the pump set device, but also enables the thermal energy to be used; and since the water pump may generate noise during its operation, the vibration frequency sensor converts the vibration frequency signal generated by the noise into an electrical signal and transmits the same to the controller; the controller thereupon analyzes the same, then the controller controls the vibration generator in the pump set device to start, and then the storage battery delivers the stored electric energy to the vibration generator via a circuit; and according to the vibration frequency received by the vibration frequency sensor, the controller controls the vibration generator to generate a relative vibration frequency, so that the vibration frequency of the noise and the vibration frequency generated by the vibration generator cancel each other out, thereby achieving the attenuation of the noise, and thus achieving the purpose of noise reduction and improving the noise reduction effect of the pump set device.

BRIEF DESCRIPTION OF THE DRAWINGS

The accompanying drawings are used to provide a further understanding of the present invention and constitute a part of the description. The accompanying drawings are used together with embodiments of the present invention to explain the present invention and do not constitute a limitation of the present invention. In the drawings.

Figure 1:
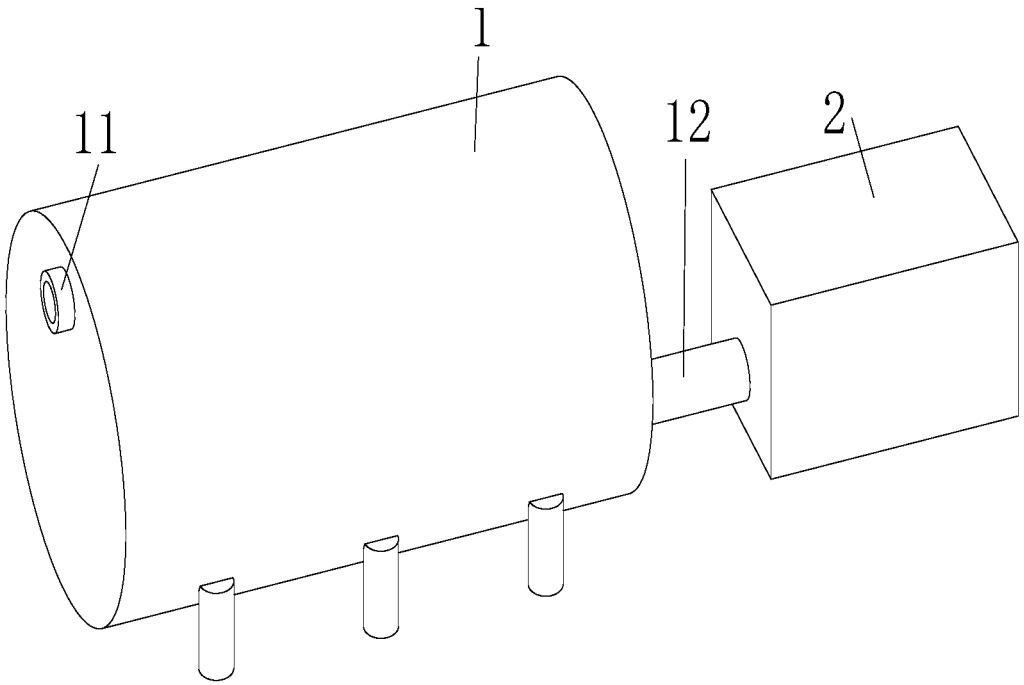
FIG. 1 is a schematic structural view of the present invention.

In the drawings: 1, water tank; 11, water inlet; 12, water outlet; 2, pump set device;

3, cleaning device; 31, rotating shaft; 32, retaining ring; 33, support arm; 34, impeller blade; 35, cleaning groove; 351, power cavity; 352, rotating gear; 36, cleaning rod; 37, sliding groove; 38, sliding block; and 39, moving groove.

DETAILED DESCRIPTION OF THE PREFERRED EMBODIMENTS

The technical solutions in the embodiments of the present invention will be clearly and completely described below in conjunction with the accompanying drawings in the embodiments of the present invention. Obviously, the described embodiments are only a part of the embodiments of the present invention, rather than all the embodiments. Based on the embodiments of the present invention, all other embodiments obtained by one of ordinary skills in the art without involving any inventive effort are within the scope of the present invention.

Figure 2:
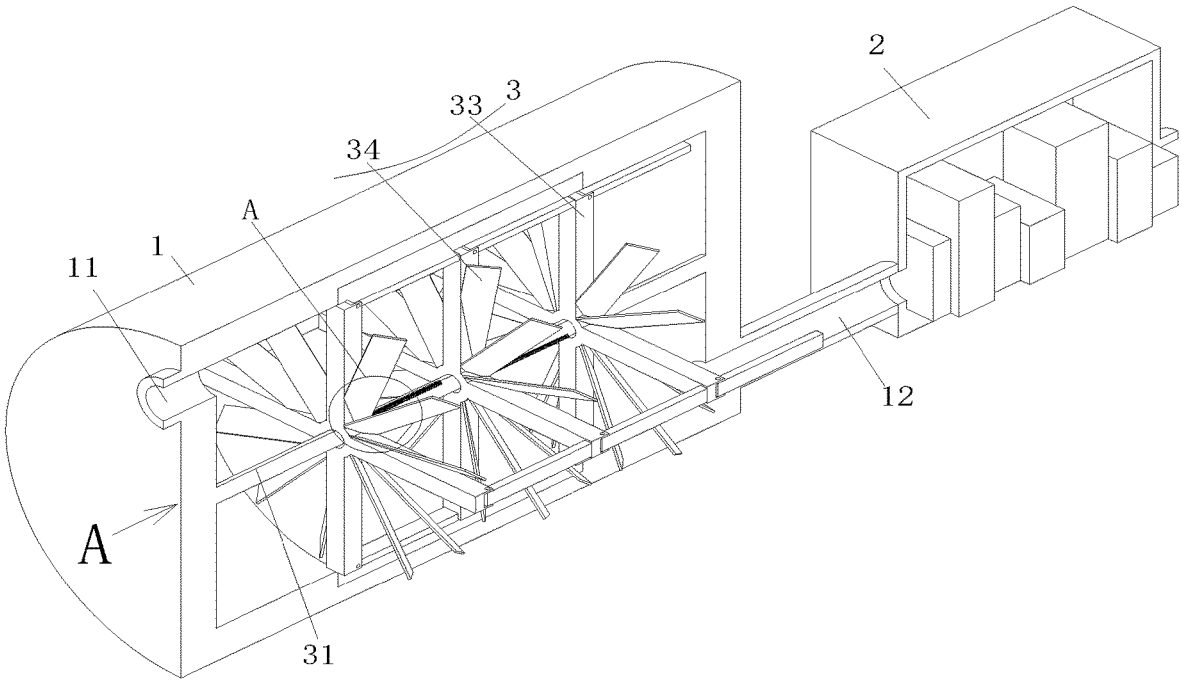
FIG. 2 is a schematic internal structural view of the present invention.
Figure 3:
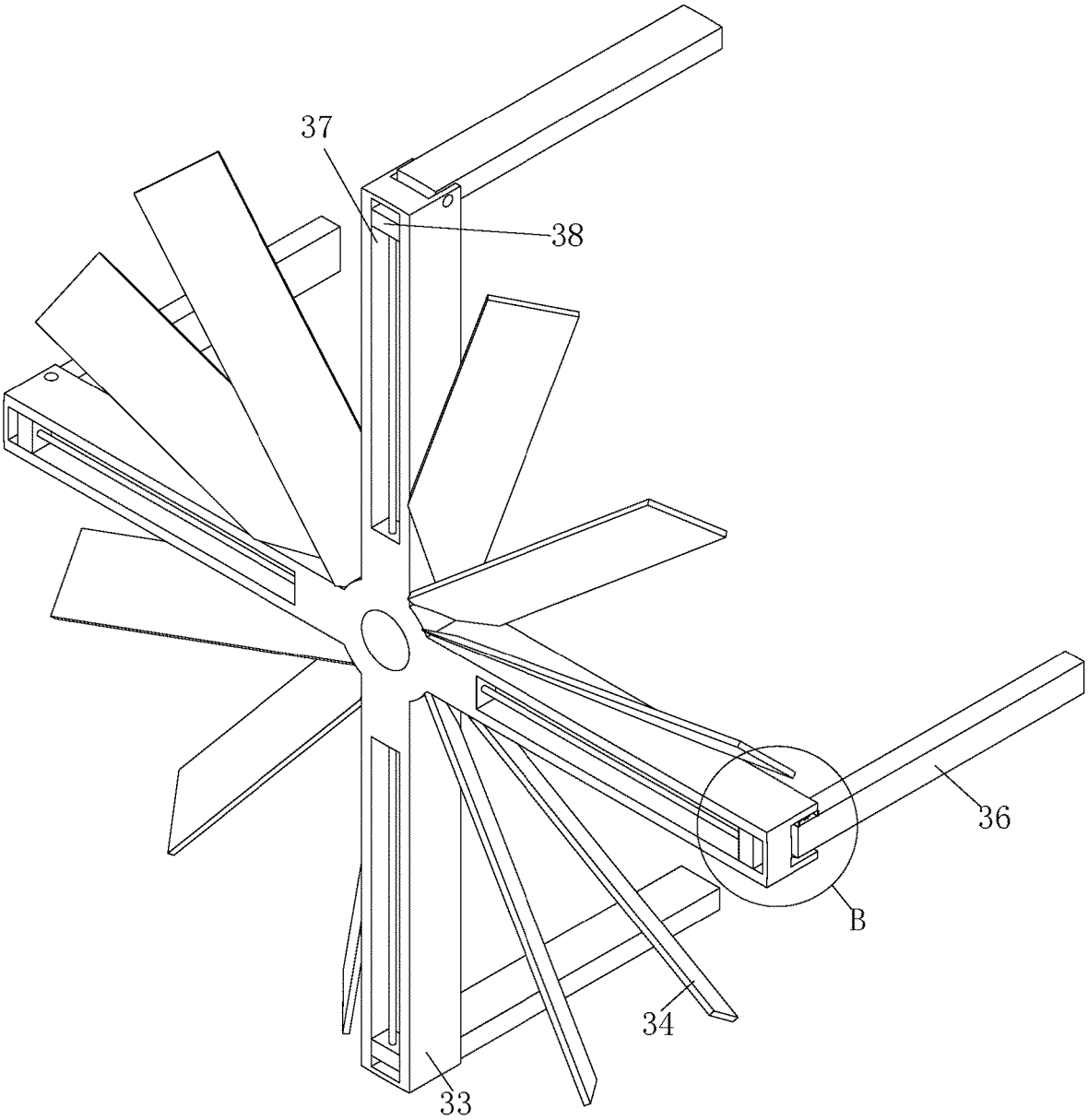
FIG. 3 is a schematic structural view when a cleaning device is unfolded.
Figure 4:
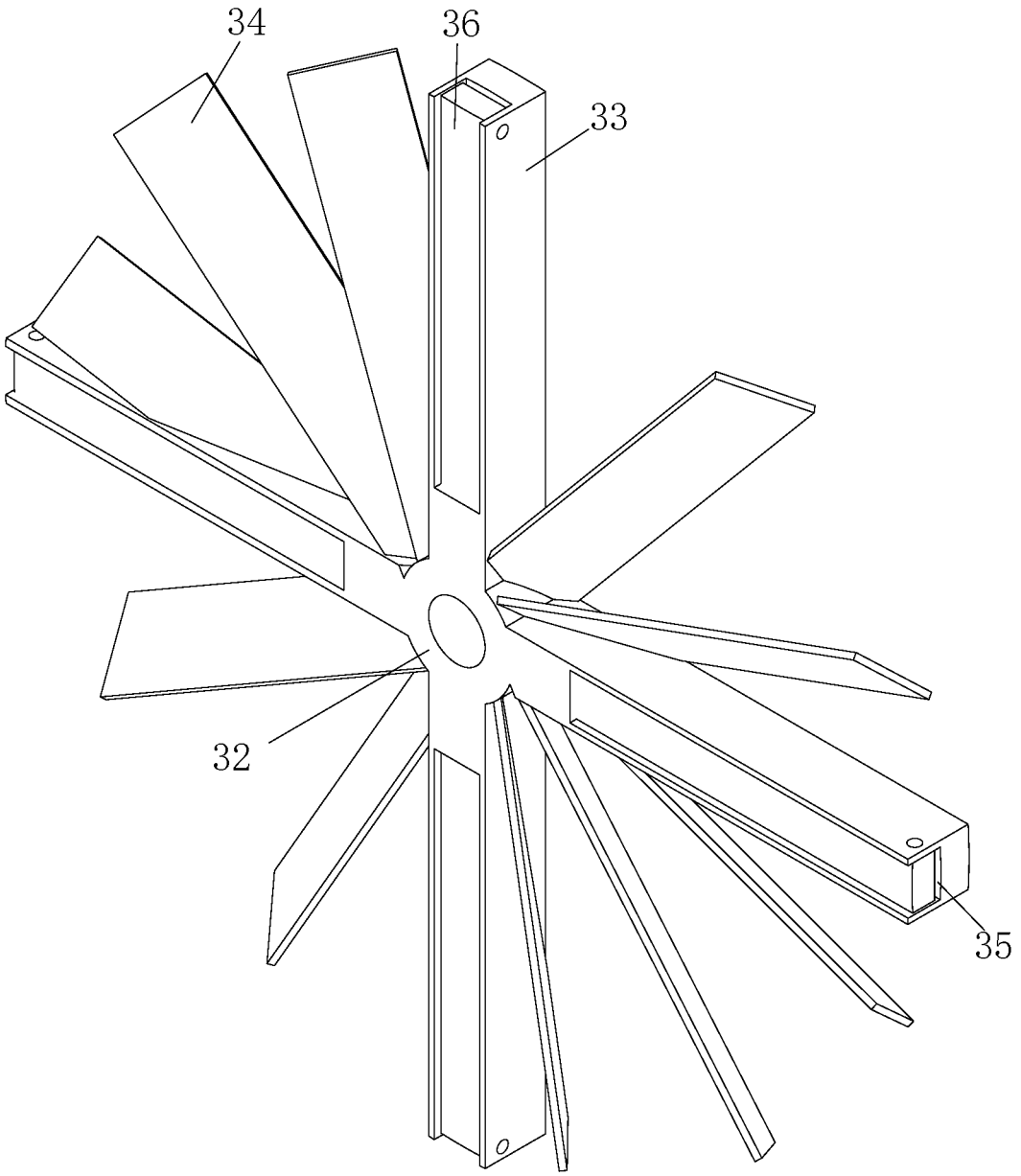
FIG. 4 is a schematic structural view when a cleaning device is closed.
Figure 5:
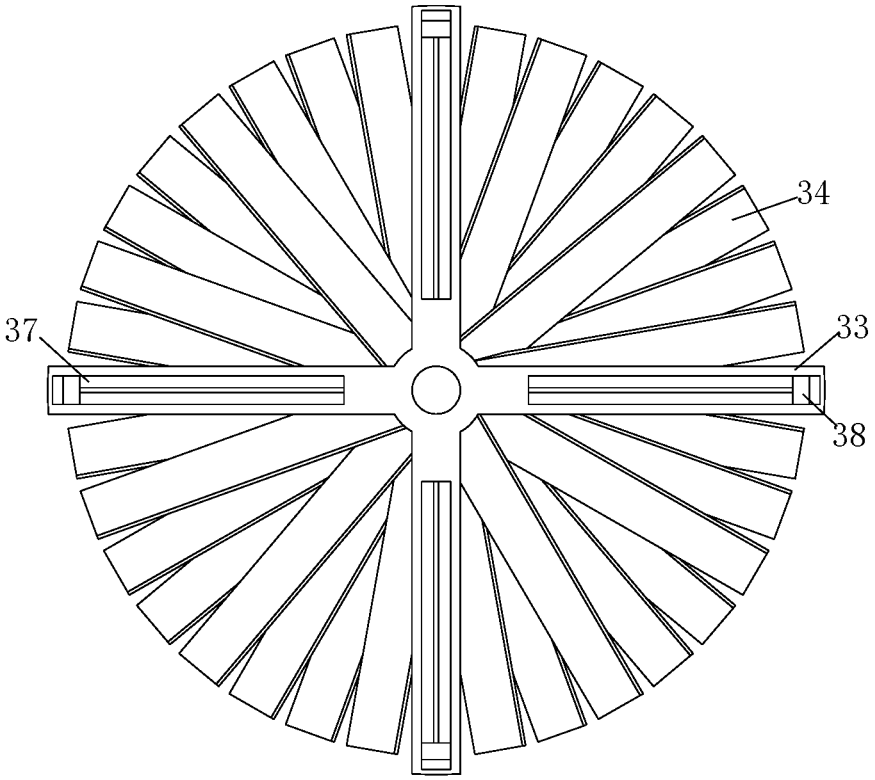
FIG. 5 is a schematic view of direction A in FIG. 2.
Figure 6:
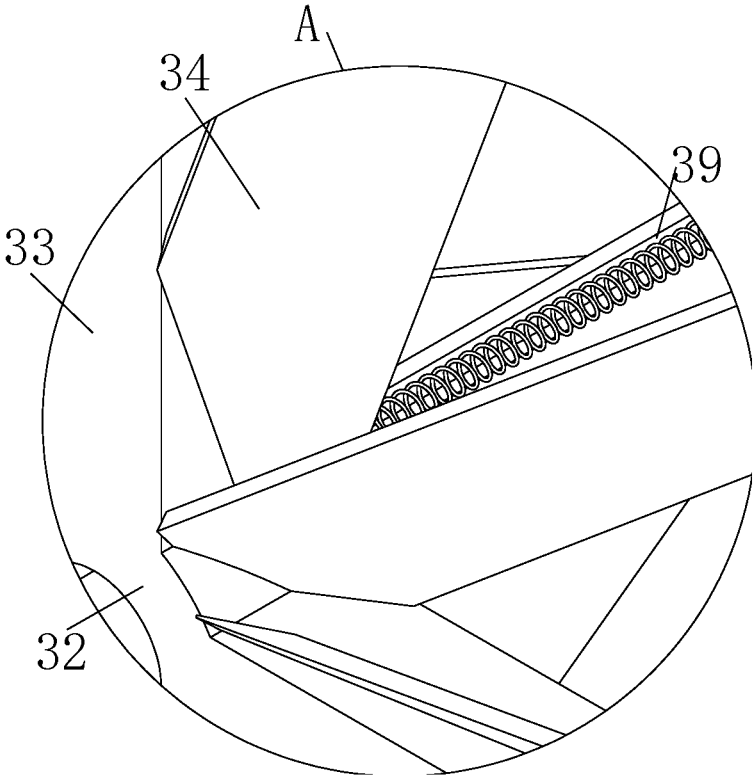
FIG. 6 is an enlarged view at A in FIG. 2.
Figure 7:
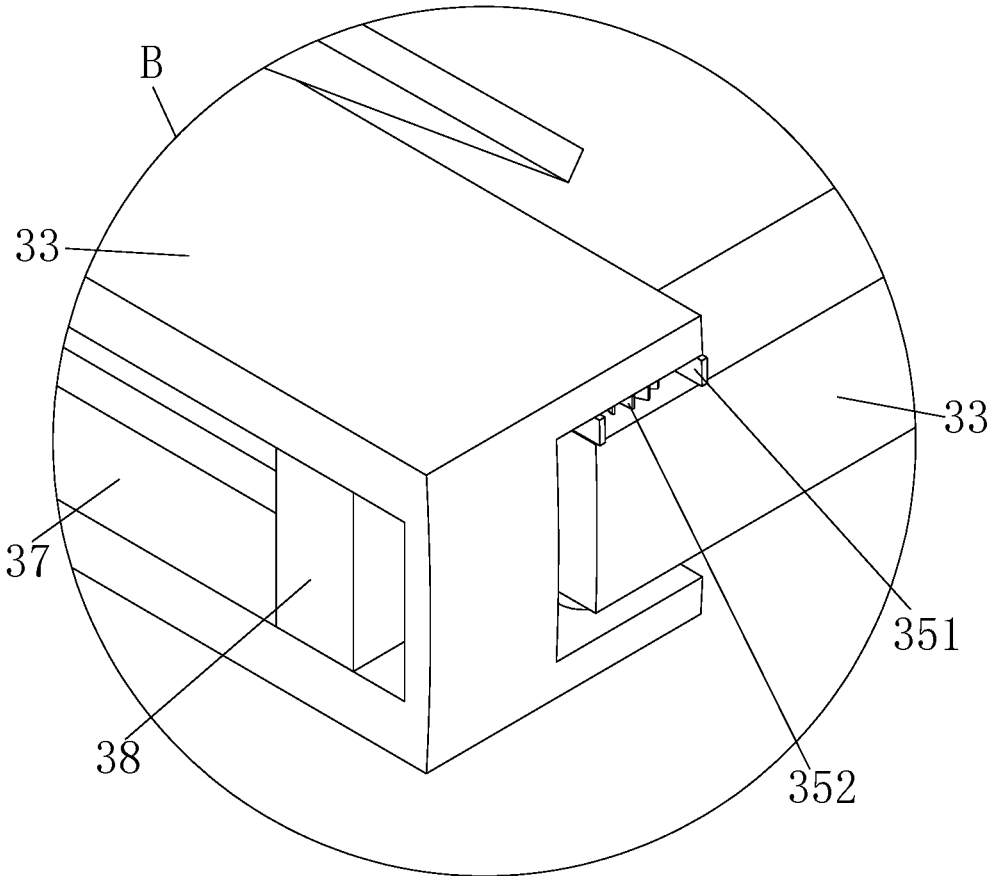
FIG. 7 is an enlarged view at B in FIG. 3.

Referring to FIGS. 1 to 7, the present invention provides a technical solution:

box-type variable frequency water supply equipment with an energy-saving function, including: a water tank 1, wherein the side wall of the water tank 1 is provided with a water inlet 11 and a water outlet 12, one end of the water outlet 12 away from the water tank 1 is provided with a pump set device 2, a cleaning device 3 is provided in the water tank 1, a water pump is provided in the pump set device 2, and the water pump is in communication with the water outlet 12 via a pipeline. The cleaning device 3 includes: a rotating shaft 31, wherein the rotating shaft 31 is arranged in the water tank 1, and the rotating shaft 31 is rotatably connected to the inner wall of the water tank 1.

A worker controls the water inlet 11 to open via a controller, and then water is delivered to the water tank 1 via the water inlet 11 for storage; when the water consumption increases, the controller controls the pump set device 2 to start and the water outlet 12 to open; the water pump in the pump set device 2 extracts water from the water tank 1; the water in the water tank 1 is then delivered to the water pump in the pump set device 2 via the water outlet 12; the water pump extracts water into the pipe system so as to realize pipeline water supply; and during the delivery of the water in the water tank 1 to the water outlet 12, the controller controls the cleaning device 3 to start, and the cleaning device 3 then rotates under the action of the water flow. During the rotation of the cleaning device 3, the inner wall of the water tank 1 is cleaned, and the cleaning device 3 cleans impurities attached to the inner wall of the water tank 1 to prevent impurities from accumulating on the inner wall to form scales.

As a specific implementation mode of the present invention, the rotating shaft 31 is provided with several retaining rings 32, one side of the retaining rings 32 away from the rotating shaft 31 is provided with several support arms 33, the support arms 33 are arranged around the axis of the retaining rings 32, and several impeller blades 34 are provided between two adjacent support arms 33. The impeller blade 34 forms an included angle with the support arm 33, and the included angle between the impeller blade 34 and the support arm 33 is 30°.

As a specific implementation mode of the present invention, an electromagnetic coil is provided inside the water tank 1 with the support arm 33 away from the retaining ring 32, the support arm 33 is a magnetic conductor, the cleaning groove 35 is provided on one side of the support arm 33 near the water outlet 12, a cleaning rod 36 is provided inside the cleaning groove 35, and the cleaning rod 36 is rotatably connected to the cleaning groove 35 via a rotating shaft.

As a specific implementation mode of the present invention, a power cavity 351 is provided inside the cleaning groove 35, a rotating shaft in the cleaning rod 36 passes through the power cavity 351 and is provided with a rotating gear 352, the rotating gear 352 is an incomplete gear, a sliding groove 37 is provided on one side of the support arm 33 away from the cleaning groove 35, a sliding block 38 is slidably connected in the sliding groove 37, a pull rope is provided inside the sliding groove 37, one end of the pull rope is connected to the sliding block 38, the other end of the pull rope is connected to the rotating shaft on the cleaning rod 36, and a torsion spring is provided on the rotating shaft on the cleaning rod 36.

As a specific implementation mode of the present invention, two moving grooves 39 are provided on the shaft arm of the rotating shaft 31, one of the moving grooves 39 is provided on one side of the rotating shaft 31 near the water inlet 11 and the other moving groove 39 is provided on one side of the rotating shaft 31 near the water outlet 12, the retaining ring 32 is slidably connected to the moving groove 39, and an electromagnetic spring is provided in the moving groove 39. One end of the electromagnetic spring is connected to the retaining ring 32, and the other end of the electromagnetic spring is connected to the side wall of the moving groove 39.

As a specific implementation mode of the present invention, several impeller blades 34 on the retaining ring 32 are arranged in an intersecting manner, the impeller blades 34 are combined into one complete impeller, and a filter screen is provided in the water outlet 12;

after the controller controls the pump set device 2 to start, the water in the water tank 1 is then delivered into the pipeline under the action of the water pump, the water in the water tank 1 moves from one side of the water inlet 11 to the water outlet 12, and during the delivery of the water in the water tank 1, the water flow impacts the impeller blade 34, the impeller blade 34 then generates a rotating force under the action of the water flow, and the impeller blade 34 then rotates; and during the rotation of the impeller blade 34, the impeller blade 34 drives the support arm 33 to rotate, the rotation of the support arm 33 drives the rotation of the retaining ring 32, and when the retaining ring 32 rotates, the retaining ring 32 drives the rotating shaft 31 to rotate;

since the support arm 33 is a magnetic conductor, during the rotation of the support arm 33, the support arm 33 continuously cuts the magnetic induction line in the electromagnetic coil provided inside the water tank 1, so that the electromagnetic coil generates a magnetic force, thereby enabling magnetically generated electricity, and the electricity generated by the electromagnetic coil is then delivered to a storage battery for storage via a circuit;

during the rotation of the support arm 33, the sliding block 38 then moves under the action of the centrifugal force; the sliding block 38 moves along the sliding groove 37 to one side away from the retaining ring 32; since the electromagnetic coil generates a magnetic force during the rotation of the support arm 33, the magnetic force also attracts the sliding block 38 to move to one side near the inner wall of the water tank 1; during the movement of the sliding block 38, the sliding block 38 drives the pull rope to move, and the pull rope is then pulled; during the sliding pulling of the pull rope, the other end of the pull rope pulls the rotating shaft on the cleaning rod 36 to rotate; during the rotation of the rotating shaft, the rotating shaft drives the cleaning rod 36 to rotate; the cleaning rod 36 moves to one side away from the cleaning groove 35; after rotating, the cleaning rod 36 contacts the inner wall of the water tank 1; when the impeller blade 34 rotates, the support arm 33 is driven to rotate; when the support arm 33 rotates, the cleaning rod 36 is driven to rotate; during the rotation of the cleaning rod 36, the inner wall of the water tank 1 is cleaned, and impurities attached to the inner wall of the water tank 1 are cleaned, so as to avoid impurities attached to the inner wall of the water tank 1 to form scales; and impurities in the water tank 1 are also not easy to attach to the inner wall of the water tank 1 under the stirring action of the support arm 33 and the impeller blade 34;

the rotation drives the rotating gear 352 in the power cavity 351 to rotate; since the rotating gear 352 is an incomplete gear, when the sliding block 38 moves to the end of the sliding groove 37, the rotating gear 352 is disengaged from the constraint of the teeth at this moment, and then the rotating gear 352 is reset under the action of the torsion spring; and in the process of resetting, the rotating gear 352 drives the rotating shaft to reset, the rotating shaft drives the cleaning rod 36 to reset, and the cleaning rod 36 rotates to one side of the cleaning groove 35, so as to realize multiple intermittent cleaning of the inner wall of the water tank 1;

when it is necessary to stop the water supply, when the controller is controlling the pump set device 2 to turn off, the controller controls the electromagnetic spring in the moving groove 39 to be energized, and the electromagnetic spring contracts upon being energized; in the process of the contraction, the electromagnetic spring drives the retaining ring 32 to move, the retaining rings 32 on two sides move along the moving groove 39 to one side away from the water inlet 11 and one side away from the water outlet 12 respectively, and then the controller controls the pump set device 2 to turn off; at this moment, the staggered impeller blades 34 are combined into one impeller whole, water forms a water hammer after the valve is closed, the water hammer impacts on the impeller blades 34, and the staggered impeller blades 34 disperse the impact force of the water hammer; and therefore, the influence of the water hammer on the pump set device 2 is reduced, and the pump set device 2 is protected; and the cleaned impurities are delivered to the water outlet 12 under the action of the water flow; and during the delivery, the impurities encounter a filter screen provided in the water outlet 12, and the impurities are then filtered by a filter plate screen.

As an implementation mode of the present invention, a storage battery (not shown in the drawings) is provided between the water tank 1 and the pump set device 2.

As a specific implementation mode of the present invention, a thermal power conversion device is provided in the pump set device 2, a vibration generator is further provided in the pump set device 2, the thermal power conversion device is electrically connected to a storage battery, the storage battery is electrically connected to the vibration generator, and a vibration frequency sensor is provided in the pump set device 2;

during the rotation of the cleaning device 3, the action of cutting a magnetic induction line is performed in the electromagnetic coil, so that the electromagnetic coil generates a magnetic force, enabling magnetically generated electricity, and the electricity is then delivered to the storage battery via a circuit for storage; the pump set device 2 is started under the control of the controller, and the water pump in the pump set device 2 generates heat during the operation; the heat accumulates in the pump set device 2, the thermal power conversion device (application No. CN201380055376.6 discloses a thermoelectric converter) is thereupon started under the control of the controller, and the thermal power conversion device thereupon converts the heat in the pump set device 2 into an electric energy; and the electric energy is also delivered to a storage battery for storage via a circuit, and after the thermal power conversion device converts the heat in the pump set device 2, not only the heat dissipation in the pump set device 2 is realized, but also the thermal energy is used; and since the water pump may generate noise during its operation, the vibration frequency sensor converts the vibration frequency signal generated by the noise into an electrical signal and transmits the same to the controller; the controller thereupon analyzes the same, then the controller controls the vibration generator in the pump set device 2 to start, and then the storage battery delivers the stored electric energy to the vibration generator via a circuit; and according to the vibration frequency received by the vibration frequency sensor, the controller controls the vibration generator to generate a relative vibration frequency, so that the vibration frequency of the noise and the vibration frequency generated by the vibration generator cancel each other out, thereby achieving the attenuation of the noise, and thus achieving the purpose of noise reduction.

The operating principles of the present invention are as follows:

a worker controls the water inlet 11 to open via a controller, and then water is delivered to the water tank 1 via the water inlet 11 for storage; when the water consumption increases, the controller controls the pump set device 2 to start and the water outlet 12 to open; the water pump in the pump set device 2 extracts water from the water tank 1; the water in the water tank 1 is then delivered to the water pump in the pump set device 2 via the water outlet 12; and the water pump extracts water into the pipe system so as to realize pipeline water supply;

after the controller controls the pump set device 2 to start, the water in the water tank 1 is then delivered into the pipeline under the action of the water pump, the water in the water tank 1 moves from one side of the water inlet 11 to the water outlet 12, and during the delivery of the water in the water tank 1, the water flow impacts the impeller blade 34, the impeller blade 34 then generates a rotating force under the action of the water flow, and the impeller blade 34 then rotates; and during the rotation of the impeller blade 34, the impeller blade 34 drives the support arm 33 to rotate, the rotation of the support arm 33 drives the rotation of the retaining ring 32, and when the retaining ring 32 rotates, the retaining ring 32 drives the rotating shaft 31 to rotate;

since the support arm 33 is a magnetic conductor, during the rotation of the support arm 33, the support arm 33 continuously cuts the magnetic induction line in the electromagnetic coil provided inside the water tank 1, so that the electromagnetic coil generates a magnetic force, thereby enabling magnetically generated electricity, and the electricity generated by the electromagnetic coil is then delivered to a storage battery for storage via a circuit;

during the rotation of the support arm 33, the sliding block 38 then moves under the action of the centrifugal force; the sliding block 38 moves along the sliding groove 37 to one side away from the retaining ring 32; since the electromagnetic coil generates a magnetic force during the rotation of the support arm 33, the magnetic force also attracts the sliding block 38 to move to one side near the inner wall of the water tank 1; during the movement of the sliding block 38, the sliding block 38 drives the pull rope to move, and the pull rope is then pulled; during the sliding pulling of the pull rope, the other end of the pull rope pulls the rotating shaft on the cleaning rod 36 to rotate; during the rotation of the rotating shaft, the rotating shaft drives the cleaning rod 36 to rotate; the cleaning rod 36 moves to one side away from the cleaning groove 35; after rotating, the cleaning rod 36 contacts the inner wall of the water tank 1; when the impeller blade 34 rotates, the support arm 33 is driven to rotate; when the support arm 33 rotates, the cleaning rod 36 is driven to rotate; during the rotation of the cleaning rod 36, the inner wall of the water tank 1 is cleaned, and impurities attached to the inner wall of the water tank 1 are cleaned, so as to avoid impurities attached to the inner wall of the water tank 1 to form scales; and impurities in the water tank 1 are also not easy to attach to the inner wall of the water tank 1 under the stirring action of the support arm 33 and the impeller blade 34;

the rotation drives the rotating gear 352 in the power cavity 351 to rotate; since the rotating gear 352 is an incomplete gear, when the sliding block 38 moves to the end of the sliding groove 37, the rotating gear 352 is disengaged from the constraint of the teeth at this moment, and then the rotating gear 352 is reset under the action of the torsion spring; and in the process of resetting, the rotating gear 352 drives the rotating shaft to reset, the rotating shaft drives the cleaning rod 36 to reset, and the cleaning rod 36 rotates to one side of the cleaning groove 35, so as to realize multiple intermittent cleaning of the inner wall of the water tank 1;

when it is necessary to stop the water supply, when the controller is controlling the pump set device 2 to turn off, the controller controls the electromagnetic spring in the moving groove 39 to be energized, and the electromagnetic spring contracts upon being energized; in the process of the contraction, the electromagnetic spring drives the retaining ring 32 to move, the retaining rings 32 on two sides move along the moving groove 39 to one side away from the water inlet 11 and one side away from the water outlet 12 respectively, and then the controller controls the pump set device 2 to turn off; at this moment, the staggered impeller blades 34 are combined into one impeller whole, water forms a water hammer after the valve is closed, the water hammer impacts on the impeller blades 34, and the staggered impeller blades 34 disperse the impact force of the water hammer; and therefore, the influence of the water hammer on the pump set device 2 is reduced, and the pump set device 2 is protected;

the cleaned impurities are delivered to the water outlet 12 under the action of the water flow; and during the delivery, the impurities encounter a filter screen provided in the water outlet 12, and the impurities are then filtered by a filter plate screen;

during the rotation of the cleaning device 3, the action of cutting a magnetic induction line is performed in the electromagnetic coil, so that the electromagnetic coil generates a magnetic force, enabling magnetically generated electricity, and the electricity is then delivered to the storage battery via a circuit for storage; the pump set device 2 is started under the control of the controller, and the water pump in the pump set device 2 generates heat during the operation; the heat accumulates in the pump set device 2, the thermal power conversion device is thereupon started under the control of the controller, and the thermal power conversion device thereupon converts the heat in the pump set device 2 into an electric energy; and the electric energy is also delivered to a storage battery for storage via a circuit, and after the thermal power conversion device converts the heat in the pump set device 2, not only the heat dissipation in the pump set device 2 is realized, but also the thermal energy is used; and since the water pump may generate noise during its operation, the vibration frequency sensor converts the vibration frequency signal generated by the noise into an electrical signal and transmits the same to the controller; the controller thereupon analyzes the same, then the controller controls the vibration generator in the pump set device 2 to start, and then the storage battery delivers the stored electric energy to the vibration generator via a circuit; and according to the vibration frequency received by the vibration frequency sensor, the controller controls the vibration generator to generate a relative vibration frequency, so that the vibration frequency of the noise and the vibration frequency generated by the vibration generator cancel each other out, thereby achieving the attenuation of the noise, and thus achieving the purpose of noise reduction.

It needs to be noted that the relational terms such as the first and the second, and the like herein are merely intended to distinguish one entity or operation from another entity or operation without necessarily requiring or implying any actual such relationship or order between such entities or operations. Furthermore, the terms "comprises" "comprising" or any other variation thereof, are intended to cover a non-exclusive inclusion, such that a process, a method, an article, or equipment that comprises a list of elements not only includes those elements but also includes other elements not expressly listed or elements inherent to such process, method, article, or equipment.

Finally, it should be noted that the above is only the preferred embodiment of the present invention and is not intended to limit the present invention. Although the present invention has been described in detail with reference to the above embodiments, those skilled in the art can still modify the technical solutions recorded in the above embodiments or replace some of the technical features equally. Any modification, equivalent replacement, improvement, etc. made within the spirit and principle of the present invention shall be included in the protection scope of the present invention.

The invention claimed is:

1. Box-type variable frequency water supply equipment with an energy-saving function, comprising: a water tank (1), wherein a side wall of the water tank (1) is provided with a water inlet (11) and a water outlet (12), one end of the water outlet (12) away from the water tank (1) is provided with a pump set device (2), the water tank (1) is provided therein with a cleaning device (3), the pump set device (2) is provided therein with a water pump, the water pump is in communication with the water outlet (12) via a pipeline, and the cleaning device (3) comprises: a rotating shaft (31) provided in the water tank (1), the rotating shaft (31) being rotatably connected to an inner wall of the water tank (1). wherein several retaining rings (32) are arranged on the rotating shaft (31), several support arms (33) are arranged on one side of the retaining rings (32) away from the rotating shaft (31), the support arms (33) are arranged around an axis of the retaining rings (32), several impeller blades (34) are arranged between two adjacent support arms (33), and the impeller blades (34) form an included angle with the support arms (33).

2. The box-type variable frequency water supply equipment with an energy-saving function according to claim 1, characterized in that: an electromagnetic coil is provided inside the water tank (1) with the support arm (33) away from the retaining ring (32), the support arm (33) is a magnetic conductor, a cleaning groove (35) is provided on one side of the support arm (33) near the water outlet (12), a cleaning rod (36) is provided inside the cleaning groove (35), and the cleaning rod (36) is rotatably connected to the cleaning groove (35) via a rotating shaft.

3. The box-type variable frequency water supply equipment with an energy-saving function according to claim 2, characterized in that: a power cavity (351) is provided inside the cleaning groove (35), a rotating shaft in the cleaning rod (36) passes through the power cavity (351) and is provided with a rotating gear (352), the rotating gear (352) is an incomplete gear, a sliding groove (37) is provided on one side of the support arm (33) away from the cleaning groove (35), a sliding block (38) is slidably connected in the sliding groove (37), a pull rope is provided inside the sliding groove (37), one end of the pull rope is connected to the sliding block (38), the other end of the pull rope is connected to the rotating shaft on the cleaning rod (36), and a torsion spring is provided on the rotating shaft on the cleaning rod (36).

4. The box-type variable frequency water supply equipment with an energy-saving function according to claim 1, characterized in that: two moving grooves (39) are provided on a shaft arm of the rotating shaft (31), wherein one of the moving grooves (39) is provided on one side of the rotating shaft (31) near the water inlet (11), the other of the moving grooves (39) is provided on one side of the rotating shaft (31) near the water outlet (12), the retaining ring (32) is slidably connected to the moving groove (39), an electromagnetic spring is provided in the moving groove (39), one end of the electromagnetic spring is connected to the retaining ring (32), and the other end of the electromagnetic spring is connected to a side wall of the moving groove (39).

5. The box-type variable frequency water supply equipment with an energy-saving function according to claim 1, characterized in that: several impeller blades (34) on the retaining ring (32) are arranged in an intersecting manner, the impeller blades (34) are combined into one complete impeller, and a filter screen is provided in the water outlet (12).

6. The box-type variable frequency water supply equipment with an energy-saving function according to claim 2, characterized in that: a storage battery is provided between the water tank (1) and the pump set device (2), and an included angle between the impeller blade (34) and the support arm (33) is 30°-45°.

7. The box-type variable frequency water supply equipment with an energy-saving function according to claim 6, characterized in that: a thermal power conversion device is provided in the pump set device (2), a vibration generator is further provided in the pump set device (2), the thermal power conversion device is electrically connected to a storage battery, the storage battery is electrically connected to the vibration generator, and a vibration frequency sensor is provided in the pump set device (2).

* * * * *